United States Patent [19]

Bertrand

[11] Patent Number: 4,809,980

[45] Date of Patent: Mar. 7, 1989

[54] PICTORIAL BLOCK PUZZLE

[75] Inventor: Vic. Bertrand, Dollard des Ormeaux, Canada

[73] Assignee: The Ritvik Group Inc., Dorval, Canada

[21] Appl. No.: 147,859

[22] Filed: Jan. 25, 1988

[51] Int. Cl.[4] ..... A63F 9/10

[52] U.S. Cl. ..... 273/157 R; 273/DIG. 25; 434/96; 446/118

[58] Field of Search ..... 273/157 R, DIG. 25; 434/96; 446/85, 118

[56] References Cited

U.S. PATENT DOCUMENTS

| | | | |
|---|---|---|---|
| 1,403,196 | 1/1922 | Rasely | 446/85 |
| 2,002,077 | 5/1935 | Darling et al. | 273/157 R |
| 2,500,263 | 3/1950 | Pascoo | 446/118 X |
| 2,771,294 | 11/1956 | MacChesney | 273/DIG. 25 X |
| 3,689,075 | 9/1972 | Adelsohn | 273/157 R |
| 4,307,886 | 12/1981 | Kemper | 273/157 R X |

FOREIGN PATENT DOCUMENTS

| | | | |
|---|---|---|---|
| 60919 | 8/1954 | France | 446/118 |
| 675678 | 7/1952 | United Kingdom | 273/157 R |
| 2127305 | 4/1984 | United Kingdom | 273/157 R |

*Primary Examiner*—Anton O. Oechsle

*Attorney, Agent, or Firm*—Robic, Robic & Associates

[57] ABSTRACT

There is disclosed a pictorial block puzzle capable of reproducing three different pictures. It consists of a pedestal and of a set of puzzle blocks. The pedestal has a flat upper face and a group of identical plugs projecting from its upper face; the plugs being disposed along orthogonal lines and being equally spaced from one another along those lines. The puzzle blocks are hollow cubes of equal size of which three walls illustrate a portion of one of the three pictures while the other walls are pierced with openings large enough to allow mounting of the cubes around one of the plugs of the pedestal to reproduce one of the pictures when all of the picture portions face up and are properly positioned. A block manipulator is also disclosed which comprises a handle having an air conduit including air openings at the ends of the handle and a section cup fixed to one end of the handle and having a central air opening registering with the air opening of the one end of the conduit, the suction cup being sized to be applied fully over the block flat face.

1 Claim, 3 Drawing Sheets

PICTORIAL BLOCK PUZZLE

BACKGROUND OF THE INVENTION

1. Field of the Invention

The present invention relates to a new type of pictorial block puzzle.

2. Description of the Prior Art

Pictorial block puzzles are well known games involving a number of identically sized cubes, usually wooden cubes, on each of the six faces of which is illustrated a portion of one of six pictures showing different subjects When properly selected as to subject and also properly placed contiguous to one another, the faces lying in the upper place formed by the assembled blocks reproduce one of the six pictures. This type of block puzzle is well known and quite popular with young children.

In construction toy games, such as are described in Applicants' prior U.S. application No. 838,321 of Mar. 13, 1986, allowed on Dec. 3, 1988, now U.S. Pat. No. 4,740,189, and pending application No. 100,211 of Sept. 23, 1987, use is often made of a flat pedestal (not shown in the applications) from the upper face of which project a plurality of identical plugs disposed along orthogonal lines and equally spaced along these lines. For building various types of constructions, the game provides, among others, building elements in the form of hollow rectangular parallelepiped bodies. Each body has four sidewalls that define, along their adjacent edges, one open end and one closed end facing the open end. Four symmetrically disposed identical cylindrical plugs project away from the closed end while a cylindrical stabilizing element projects also from the closed end but centrally inwardly of the hollow body in the direction of the open end. In use, such a building element is mounted on the foundation pedestal by insertion of the stabilizing element in the nip between four adjacent plugs of the pedestal; the cylindrical stabilizing element having a diameter allowing it to fit tangentially between the mentioned four plugs.

SUMMARY OF THE INVENTION

An object of the present invention is to create a new pictorial block puzzle using the known pedestal described above and building elements modified as puzzle blocks. The latter are in the form of identical hollow cubes having at least one face illustrating a portion of one picture while the opposite face of the cube is at least partially open. The opening in this opposite face is sized to allow the cube to fit around one of the plugs of the foundation pedestal. The hollow cubes, carrying the portions of the picture, are outwardly sized with respect to the spacing between the pedestal plugs, such as to adjoin one another when the blocks are fitted around the plugs. In this manner, the playing child is asked to properly locate the cubes around the plugs of the foundation pedestal so that the cube faces reproduce the selected picture. When up to three faces of each cube are provided with portions of three respective pictures, the child must also select all of the cube faces relevant to a selected one of the three pictures prior to locating said cubes around the plugs.

More specifically and in accordance to one aspect of the invention, there is provided a pictorial block puzzle capable of reproducing at least one picture, the puzzle comprising a pedestal having an upper face and a plurality of identical plugs projecting from the upper face, the plugs being disposed along orthogonal lines and being equally spaced from one another along the lines;

a plurality of puzzle blocks in the form of hollow cubes of equal size each having at least one outer face illustrating a portion of said at least one picture each of said at least one outer face being opposite to another outer face of the cube formed with an opening suitable for the cube to fit around one of the plugs of the pedestal, the cubes being outwardly sized, with respect to the spacing between the pedestal plugs, such as to adjoin one another when the blocks are fitted around the plugs.

Preferably, three adjacent faces of each cube are used to illustrate portions of three different pictures, thereby making the puzzle more complicated.

According to another aspect, the invention provides for a block manipulator for placing or removing a block on or from a completed pictorial block puzzle, the block having a flat face and the manipulator comprising:

a handle having an air conduit including air openings at the ends of the handle; and a suction cup operatively fixed to one end of the handle and having a central air opening registering with the air opening of the one end of the conduit, the suction cup being sized to be applied fully over the block flat face.

Still according to a further aspect, there is provided a pictorial puzzle block in the form of a hollow cube of which the outer faces of three adjacent walls thereof illustrate a portion of one of three different pictures while the outer faces of the remaining three walls are formed with through openings.

A description now follows of a preferred embodiment of the invention, having reference to the appended drawings.

BRIEF DESCRIPTION OF THE DRAWINGS

FIG. 4, first sheet of drawings, is a perspective view of a block manipulator.

DESCRIPTION OF THE PREFERRED EMBODIMENT

Figure 1:
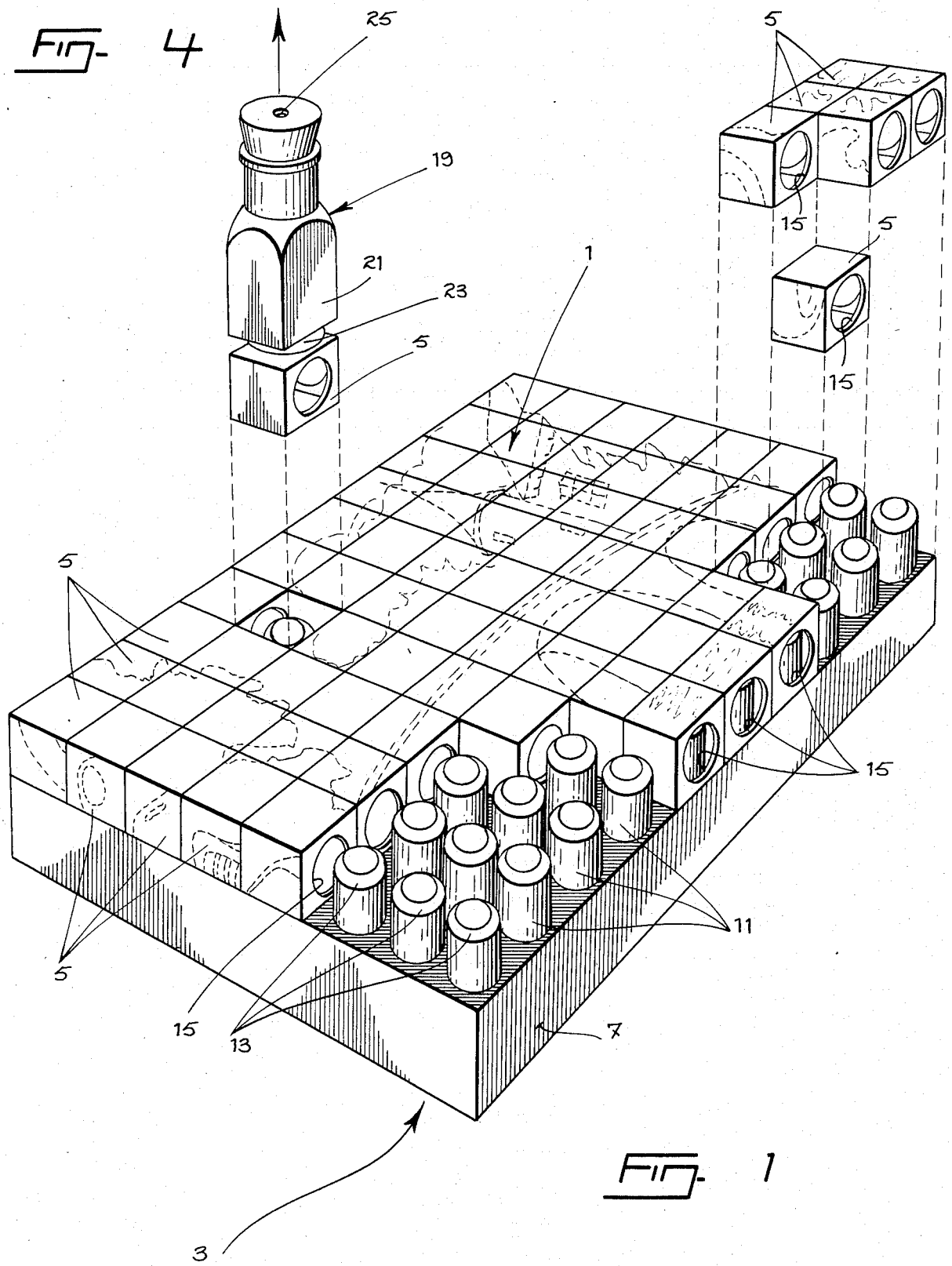
FIG. 1 is a perspective view of a block puzzle according to the invention, partly exploded.
Figure 2A:
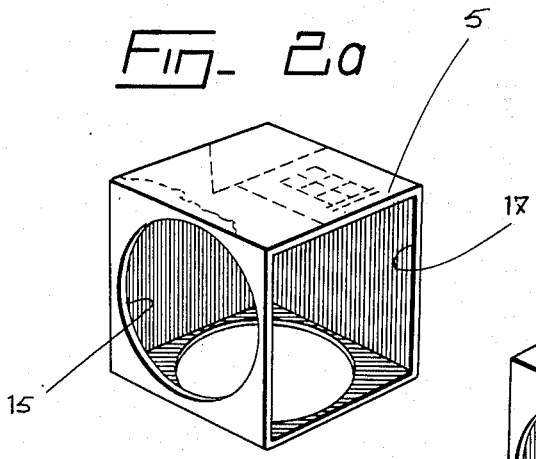
FIGS. 2, *a* and *b*, are perspective views of a puzzle block viewed at two different angles.
Figure 2B:
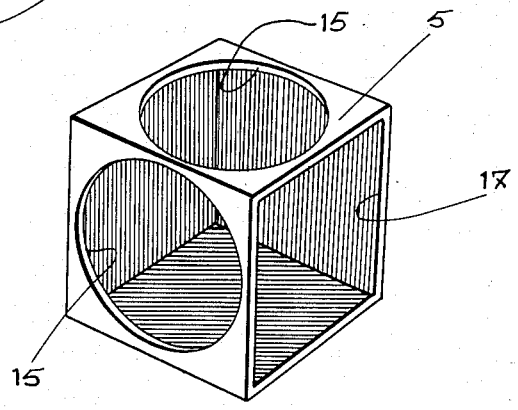
Figure 3A:
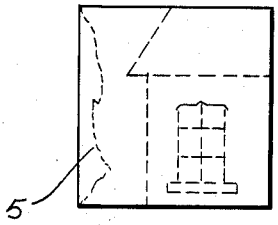
FIG. 3, *a–e*, are plan views showing five faces of a puzzle block.
Figure 3D:
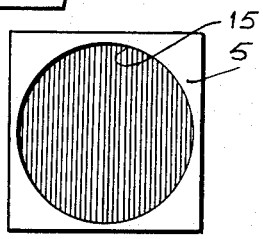
Figure 3E:
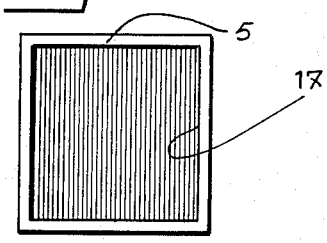
Figure 3B:
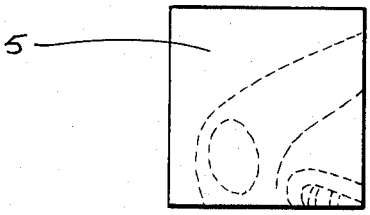
Figure 3C:
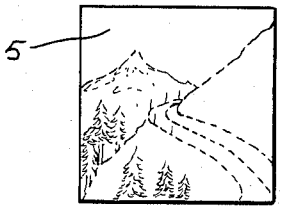

Referring to FIG. 1, a pictorial block puzzle is shown which is capable of reproducing three different pictures of which one picture 1 is shown partially completed.

The puzzle is composed of a pedestal 3 and of a number of blocks 5 to be mounted on the pedestal. The latter is a known element made up of a base 7 having a flat upper surface 9 from which projects a series of identical cylindrical plugs 11, chamfered as at 13. The plugs are disposed along orthogonal lines and are equally spaced along these lines so that the axial center lines of four adjacent plugs lie at the four corners of a square. The pedestal 3 is molded in plastic material.

The puzzle blocks 5, also moulded in plastic material, are in the form of hollow cubes having the same size. As best illustrated in FIGS. 3, *a*, *b* and *c*, the outer faces of three walls of each block illustrate a portion of one of three pictures, such as picture 1 in FIG. 1, while two of the remaining three walls are formed with a round opening 15 (FIG. 3*d*) and the last wall is formed with a square opening 17 (FIG. 3*e*); the square configuration resulting from the selected process used for moulding the blocks. All these openings are properly sized so that the blocks can fit around the plugs 11 of the pedestal 3. The blocks 5 must also be outwardly sized, with respect to the spacing between the pedestal plugs 11, such as to adjoin one another when all blocks are fitted around the plugs, as will be appreciated from FIG. 1. The blocks 5 should fit closely around the plugs 11 although a limited looseness would be preferred for easing their removal from the pedestal. It will be noted also that one wall of each block 5 that carries a portion of a picture faces a wall pierced with an opening 15, 17, so that any picture-carrying wall may be placed facing up, as in FIG. 1.

Figure 6:
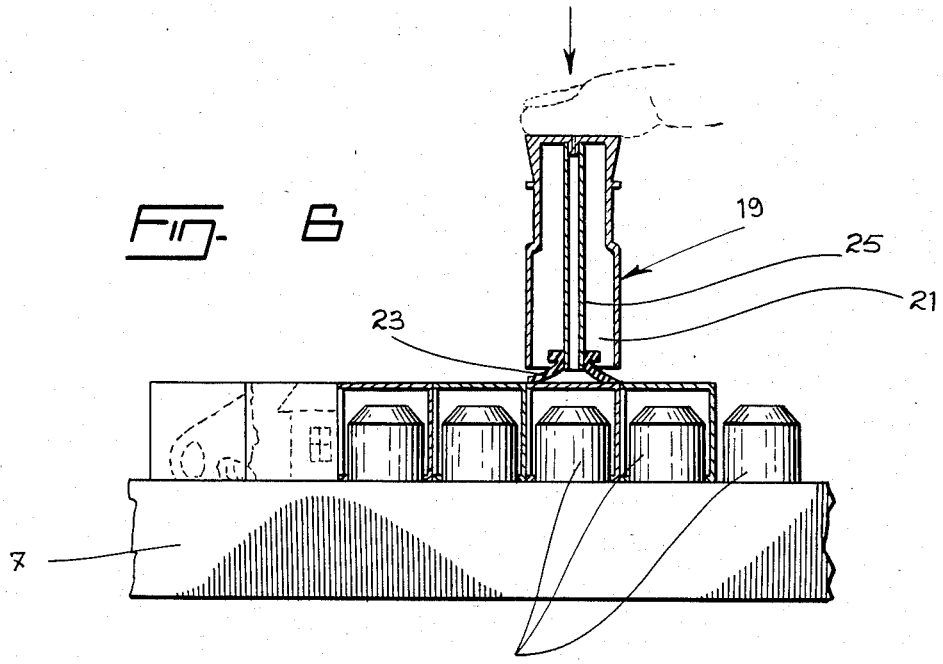
FIGS. 5 and 6 are side elevation views showing two successive steps in the extraction or removal of a block from the pedestal.
Figure 5:
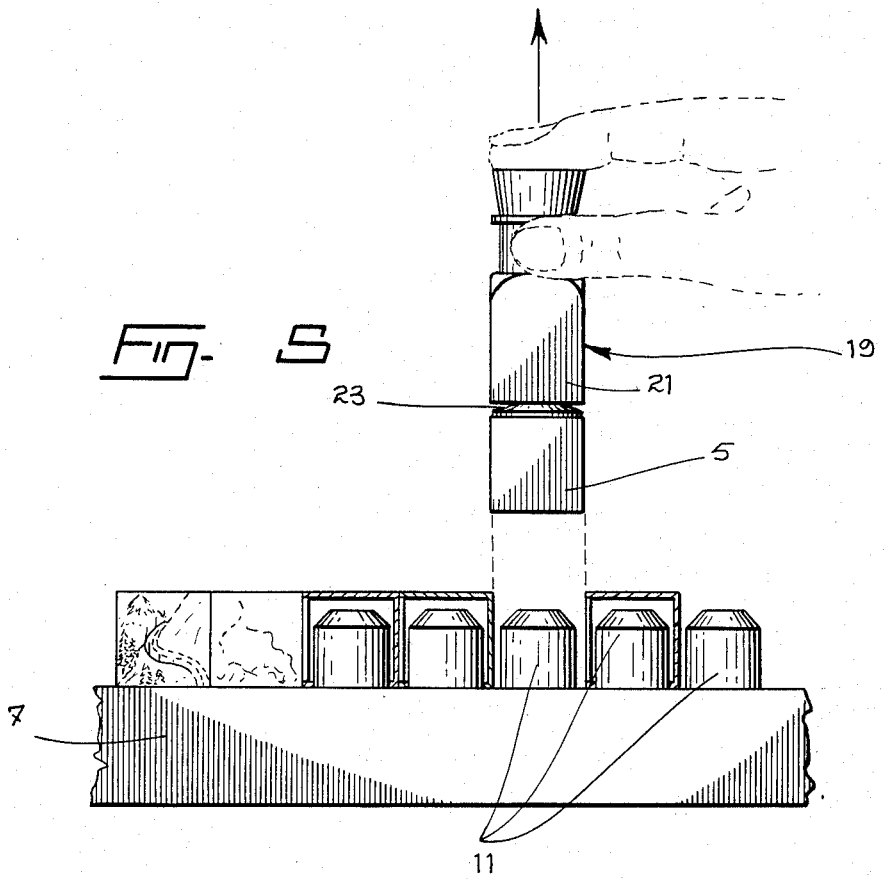

Each block 5 may of course be placed on or removed from the pedestal 3 by hand, as in the old wooden block puzzle, but the invention proposes a block suction manipulator 19, as shown in FIGS. 4, 5 and 6. It consists of a handle 21 and of a rubber suction cup 23 at one end of the handle. The latter is a square element within which is mounted, in any known manner, a conduit 25 having air openings at the ends of the handle. Alternatively, the handle 21 may be solid and pierced lengthwise with an open-ended bore acting as the conduit 25. The suction cup 23, on the other end is secured to one end of the handle 21 and has an air opening which registers with the air opening at the corresponding end of the handle. The cup 23 is sized to fit over any plain wall of the blocks 5. In use, the child places the manipulator 19 with its cup 23 lying flatly over a plain wall of a block 5 and presses down on the handle 21 while his index blocks the upper end of the conduit to expel air from beneath the cup 23 (FIG. 5). The block may then be easily pulled up by virtue of the suction created by the cup 23.

All of the construction elements of the puzzle are preferably made of plastic material.

I claim:

1. A pictorial block puzzle kit capable of reproducing different pictures, said kit comprising:

a pedestal having an upper face and a plurality of plugs projecting up from said upper face; said plugs being equally spaced from one another along orthogonal lines such that the axial center lines of any four adjacent plugs lie at the four corners of a square;

a plurality of puzzle blocks in the form of cubes of equal size; each cube having three only outer plain faces illustrating a portion of one picture, each one of said illustrative plain faces being opposite to another outer face of the cube formed with an opening; said opening leading into said cubes and being sized to fit around said plugs;

wherein said plugs have a predetermined length selected so that said plugs are fully housed within said cubes when said cubes are fitted thereover;

wherein said cubes are outwardly sized, with respect to said spacing between said pedestal plugs, such as to adjoin one another when said cubes are fitted over said plugs; and a suction cup manipulator for placing or removing a selected one of said puzzle cubes over said pedestal plugs.

* * * * *